United States Patent [19]

Leigh et al.

[11] 4,336,740

[45] Jun. 29, 1982

[54] AUTOMATIC BLAST ACTUATED POSITIVE RELEASE MISSILE DETENT

[75] Inventors: Michael L. Leigh, Agoura; Richard D. Stubbs, Woodland Hills, both of Calif.

[73] Assignee: Hughes Aircraft Company, Culver City, Calif.

[21] Appl. No.: 974,479

[22] Filed: Dec. 29, 1978

[51] Int. Cl.[3] ..... F41F 3/04

[52] U.S. Cl. ..... 89/1.806; 89/1.816

[58] Field of Search ..... 89/1.806, 1.807, 1.812, 89/1.813, 1.814, 1.816

[56] References Cited

U.S. PATENT DOCUMENTS

| | | | |
|---|---|---|---|
| 3,076,385 | 2/1963 | Bornhöft | 89/1.806 |
| 3,296,927 | 1/1967 | Jacobson | 89/1.806 |
| 3,513,749 | 5/1970 | Magnaut | 89/1.807 |
| 3,659,493 | 5/1972 | Wissner | 89/1.807 |
| 3,719,120 | 3/1973 | Elder et al. | 89/1.806 X |
| 4,132,150 | 1/1979 | Conn | 89/1.806 |

FOREIGN PATENT DOCUMENTS

| | | | |
|---|---|---|---|
| 1340562 | 12/1962 | France | 89/1.806 |
| 592861 | 11/1977 | Switzerland | 89/1.806 |

*Primary Examiner*—David H. Brown

*Attorney, Agent, or Firm*—Lewis B. Sternfels; W. H. MacAllister

[57] ABSTRACT

A missile or rocket detent and positive release mechanism is actuated by the thrustor of a rocket (10). The mechanism is mounted on a housing (42) to which a rocket launcher tube (15) is secured. A spring-loaded lever (50), having a notch (52) and a cam follower (55) at opposite ends, lies parallel to the rocket and is pivoted to the housing. Its notched end extends into the launch tube for positively locking the rocket into place. A spring-loaded sear (62) also lies parallel to the housing, is reciprocable on the launcher, and has a cam (64) which rests against the first lever's follower. At its other end, the sear is pivoted to a toggle (44) lying perpendicular to the housing so that one end (**48*b*) nests against a housing end surface (46) and its other end (48*a***) extends into the path of the exhaust from the rocket's thrustor. The rocket blast pivots the toggle around on its pivot point against the housing end surface to linearly move the sear and its cam, which pushes against the follower-end of the first lever and pivots the spring-loaded lever sufficiently to withdraw its notched-end from engagement with, and to release the rocket.

16 Claims, 6 Drawing Figures

AUTOMATIC BLAST ACTUATED POSITIVE RELEASE MISSILE DETENT

RELATION TO A GOVERNMENT CONTRACT

The invention herein disclosed was made under or in the course of a contract with the Department of the Army.

BACKGROUND OF THE INVENTION

1. Field of the Invention

The invention relates generally to rocket and missile launchers and, in particular, to a positive detent and release mechanism for a rocket or missile.

2. Description of the Prior Art

Rocket launchers are well known in the prior art and generally consist of a light weight, relatively thin aluminum launch tube having a diameter that is slightly larger than that of the body of the rocket. The launch tube may also be made of a composite material such as fiber glass or resin impregnated paper. The length of the launch tube is usually greater than that of the rocket. A plurality of launch tubes may be assembled together into a pod which is carried on pylons beneath an airplane's wing or along the fuselage of a helicopter. The firing sequence of a group of rockets is generally one at a time so that the total heat generated by the rocket motors within the pod at one time is kept at a minimum. Also, rocket collisions in free-flight are avoided. Alternatively, the missile or rocket may be launched from a rail.

In addition to the standard launcher having a flat front, an experimental supersonic rocket launcher has been fabricated for an F-4 Phantom jet which carries eighteen 2.75-inch folding fin aircraft rockets in individual aluminum launch tubes. The individual launch tubes are spaced symmetrically about a central axis. The launcher consists of three major sections. The forward section contains 18 aluminum launch tubes and provides the basic aerodynamic shape and main structural integrity and strength of the launcher. The middle section contains the electrical firing circuitry and rocket retention mechanisms. The tail section of the launcher is a hollow aerodynamic fairing designed to reduce base drag. THe launcher features a lightweight composite structure consisting of a foam encapsulated, integrally bonded aluminum tube matrix in combination with a glass fiber reinforced epoxy laminated structural system covered by an outer skin.

It is important that each of the rockets be fired properly and that each exit its respective launch tube without damaging it. In practice, it has been acceptable to have a few launch tubes in a pod that are inoperative. If more than these launch tubes should be damaged in firing their cargo, the entire launcher would have to be discarded. Thus, every damaged launch tube is a potentially expensive occurrence.

The rocket, as configured for the field has the rear stabilizer fins folded backwards so that they extend beyond the rear of the rocket body, and their leading edges lie within the projection of the body's circumference. After folding the fins, a rectangular plastic fin retainer is attached to the fin tips to keep them in place. A circular metal contact disc is disposed on the face of the plastic retainer facing away from the fins. An electrical wire connects the contact disc with the firing mechanism within the rocket. The fire signal is applied to the rocket through the metal contact disc. The body of the rocket is "grounded" through the retainer's contact with the rocket.

In loading the rocket into its launch tube, referred to as "up loading", the rocket is slid into its launch tube until the circumferential ridge, at the aft portion of the rocket body engages the detent/release mechanism. The contact disc at the same time engages an igniter contact arm through which the "fire" signal is conducted to the rocket motors. Up-loading most prior art launch tubes requires a substantial amount of force. For example, it may require a 250 pound force to release the rocket from the launch tube and, conversely it may require that same amount to engage the detent, depending upon the configuration of the particular release mechanism. It is not unusual to see technicians literally flinging the rockets into the launch tube in order to engage the detent mechanism.

In flying a mission, the rocket detent is required to perform several functions. It must keep the rocket in place at all times irrespective of the craft's attitude and the forces which are exerted on it. For instance, during aerobatic maneuvers and during landings great forces and stresses are placed on the detent mechanism which is expected to restrain the rocket. In carrier landings where arresting lines and hooks are used to stop a jet, it has been calculated that forces in excess of 9 g's are generated, which are also exerted on the detent mechanism. In catapult take-offs, forces of 6 g's have been calculated. If the detent mechanism malfunctions, the rocket could be separated from its launch tube, possibly causing extensive damage to the craft, or persons and equipment near the craft.

When the rocket motor is fired, it is expected that, within a predetermined time or within a predetermined thrust force of the rocket, the release will be actuated and the rocket will exit the launch tube. If the release mechanism should malfunction and the rocket is not released, called "hangfire", the launch pod could sustain substantial damage as well as possible damage to the aircraft structure. A hangfire in a helicopter launched rocket is especially dangerous because handling characteristics are more easily affected by outside forces due to the lighter mass of the helicopter. If a rocket fails to exit the launch tube within a few seconds of the thrustor being fired, the launch tube may sustain substantial fire damage possibly making it inoperable for future use. Certain materials, such as fiber glass, composite or aluminum within the firing end of the rocket launcher pod cannot withstand the continuous temperatures associated with the rocket motor propellant burning characteristics without damage. Ejected fragments from a failed tube may present a hazard to the aircraft. Notwithstanding the fact that most rocket pods are disposable armanent, if a sufficient number of launch tubes are damaged due to the rockets' flaming within the tube, the pods may have to be discarded prematurely. Depending upon the number of launch tubes in a particular pod, a certain number of launch tubes may be acceptable. However, when the number of damaged launch tubes exceeds a predetermined percentage of the total, then the entire pod must be discarded. Generally, these otherwise disposable rocket launch pods may be used almost indefinitely so long as the rockets and detent mechanism do not malfunction. Thus, many firings may be obtained from an individual pod.

The fin retainer is blown away by the action of the thrustors and as the rocket exits its launch tube, the folded back fins are deployed to their proper positions within a few feet of the rocket leaving the tube. Surprising results were found in tests conducted on a number of launch tubes using prior art release mechanisms, and it was found that the release forces required for each succeeding test tended to be substantially lower than the preceeding test. In other words, each subsequent rocket launch occurred earlier than the last, due to the mechanism becoming weakened from the prior firing. Eventually, the launch tubes became unusable due to the release mechanisms becoming increasingly ineffective and to the extent that they gave rise to a dangerous condition.

A prior art detent mechanism used extensively provides a longitudinal restraint to a rocket by means of a notched detent member which interfaces with the circumferential ridge aft of the rocket motor bourrelet. The detent member is held down in place, against the ridge, by a leaf spring to preclude inadvertant release due to vibration or shock loads. At launch, the detent is released by the rocket motor thrust overriding the detent restraining force. In the examination of this prior art detent mechanism after firings, it was found that the detent material had undergone permanent deformation such that the notch had become elongated until only a small ridge was left. It was found that this ridge was unable to properly restrain future loads. Another shortcoming of such prior art detent mechanisms is that release depends upon columnar bending forces, and these release forces are essentially at different times unpredictable. In some pod configurations, it is generally required that a rocket be released by forces in the range of 175 to 280 pounds. However, in several tests it was found that it took more than the maximum prescribed force to release the rocket. It appears that the erratic forces required to release the rockets are an inherent characteristic of that prior art detent. In addition, many factors increase the variation. Such excessive forces could result in damage to the pod, the mounting structure or the aircraft.

OBJECTS OF THE INVENTION

Accordingly, it is a primary object of the present invention to provide an improved, economical, and reliable detent/release mechanism.

It is another object of the present invention to provide a release mechanism having a predetermined constant release force.

It is still another object of the present invention to provide an integrated detent/release and igniter contact arm mechanism.

It is yet another object of the present invention to provide blast-actuated positive release action for a missile.

It is another object of the present invention to provide an automatic rocket release mechanism.

It is still another object of the present invention to provide a rocket launch tube which may be armed from either end.

It is yet another object of the present invention to provide a detent mechanism permitting a missile to be easily loaded into its launch tube.

In accordance with the foregoing, an automatic blast-actuated positive release detent mechanism is secured to a launch tube and includes a lever having a detent and a cam follower placed on opposite sides of a pivot point. The detent secures a missile to the launch tube. A sear, having a cam disposed against the cam follower of the detent lever, reciprocates to pivot the lever about its pivot point, and the detent out of engagement with the missile. A rotatable arm or toggle is pivotably connected to the sear, and has one end which extends into a blast region and a second end which rests against a member secured to the launch tube. When rotated by the blast, the toggle reciprocates the sear which, in turn, pivots the detent out of engagement with the missile.

DETAILED DESCRIPTION OF THE DRAWINGS

Figure 1:
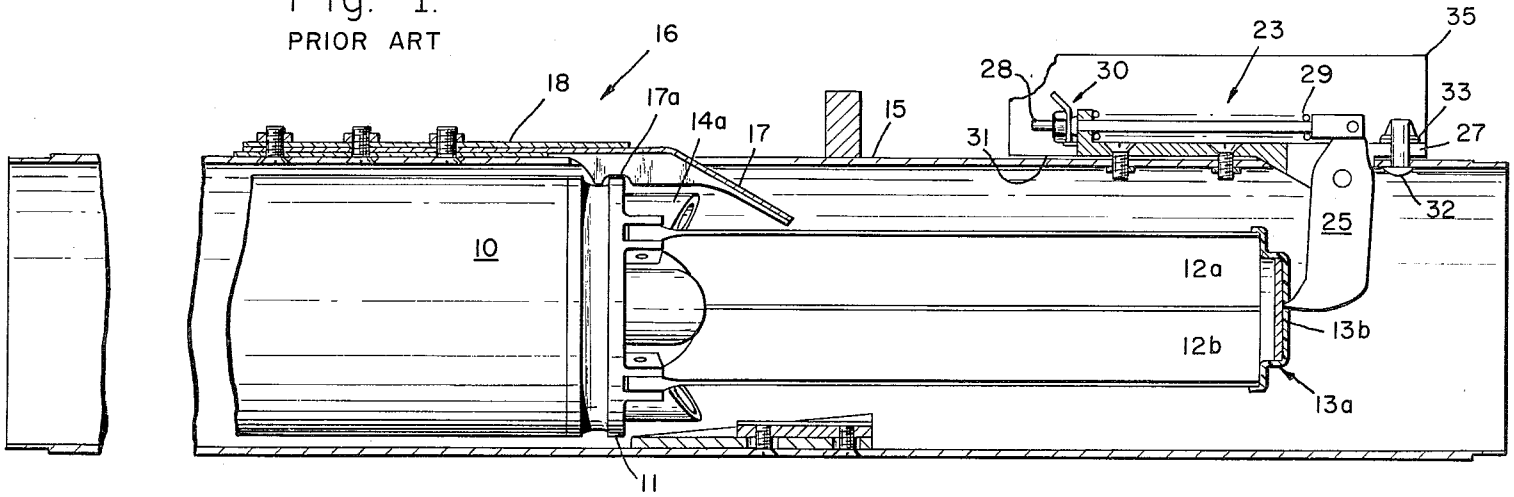
Fig. 1. PRIOR ART
FIG. 1 is a cross-section side view of a rocket in a launch tube having a prior art detent/release mechanism and a contact igniter arm assembly.

Referring specifically to FIG. 1, a prior art detent/release mechanism 16 and a contact igniter arm mechanism 23 are mounted onto a rocket launch tube 15. A rocket 10, having four fins, of which only two (12*a* and 12*d*) are illustrated, is up-loaded into the launch tube 15 through the forward end of the tube 15, after the fins have been folded backward toward the aft end of the rocket 10. A plastic fin retainer 13*a*, having a contact disc 13*b*, is attached to the fins' ends. The contact disc 13*b* is connected to the rocket motors via an electrical wire 13*c*.

The detent/release mechanism 16 includes a detent lever 17 which extends through an opening in the launch tube, and a notch 17*a* in the lever engages a circumferential ridge 11 on the rocket 10 for securing the rocket in place. The lever 17 is preloaded by a leaf spring 18 which is disposed on its top and the two are fastened to the launch tube 15 by rivets or screws. The rocket's thrust must overcome the combined forces of the leaf spring 18 and the detent lever 17 to release the rocket 10 as illustrated in FIG. 2 below.

Figure 2:
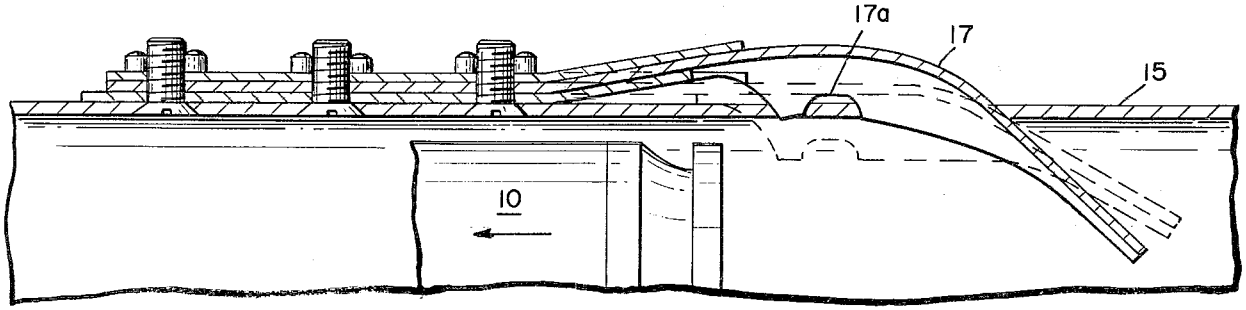
Fig. 2. PRIOR ART
FIG. 2 is a view detailing the releasing motion of the prior art device according to FIG. 1.

Referring briefly to FIG. 2, the detent mechanism 16 is illustrated as the rocket 10 is being released. The detent lever 17 is shown in a bowed configuration as it is being subjected to elastic column bending forces due to the rocket's thrust. Since such column bending forces are unstable and often unpredictable, it is difficult to accurately predetermine release forces. Repeated flexion in the manner just described has often resulted in fatique failure and fracture of the detent lever 17 just forward of the notch 17*a*. The dashed lines represent the position of the detent lever 17 when the rocket 10 is in place.

The igniter arm assembly 23 is a separate unit from the detent/release mechanism 16. An igniter arm 25 extends through the aft end of the launch tube 15 and pivots on a mounting block 27. The lower end of the igniter arm 25 is designed to make physical and electrical contact with the contact disc 13*b* for conducting the fire signal. The upper end of the igniter arm 25 is spring loaded via a push rod 28 and a compression spring 29. A spade electrical lug 30 is attached onto the threaded end of the push rod 28 for receiving the fire signal. To prevent the fire signal from shorting to the launch tube 15, a thin sheet of dielectric material 31 is interposed between the mounting block 27 and the tube 15. The screw 32 securing the mounting block 27 to the tube is also insulated by a nylon washer 33. The rivets at the forward end of the mounting block 27 are also insulated. Thus, the fire signal is applied to the entire igniter contact assembly 23 without shorting to ground. A triangular-shaped metal housing 35 is disposed about the igniter arm assembly 23 and is not in electrical contact therewith.

Due to the igniter arm 25 being permanently fastened within the tube 15, the rocket may only be up and down loaded from the forward end of the launch tube 15. Also, due to the design of the detent lever 17, the tab extending beyond the notch 17*a* must be pried up with a special pry bar to release the rocket 10 when it is being down-loaded.

The items and components depicted in FIGS. 3–6, which are the same or perform the equivalent function as items and components of FIG. 1, are identified by the same reference designation numerals as in FIG. 1.

Figure 3:
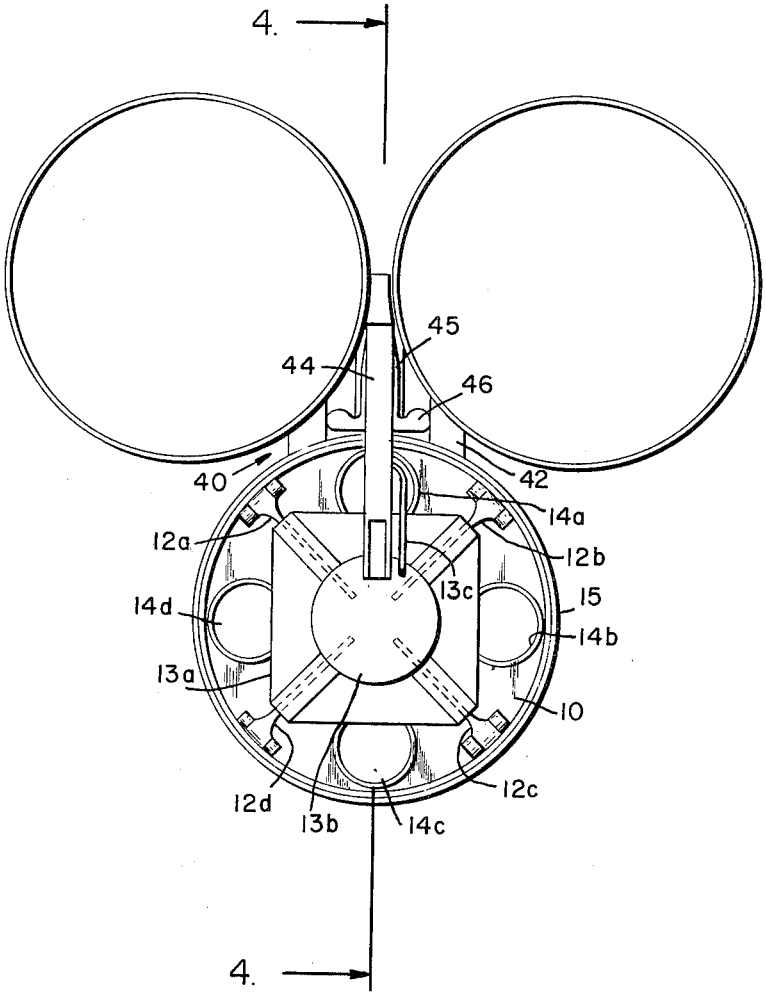
FIG. 3 is an end view of a rocket detent mechanism according to the present invention, mounted on a launch tube within a matrix.
Figure 4:
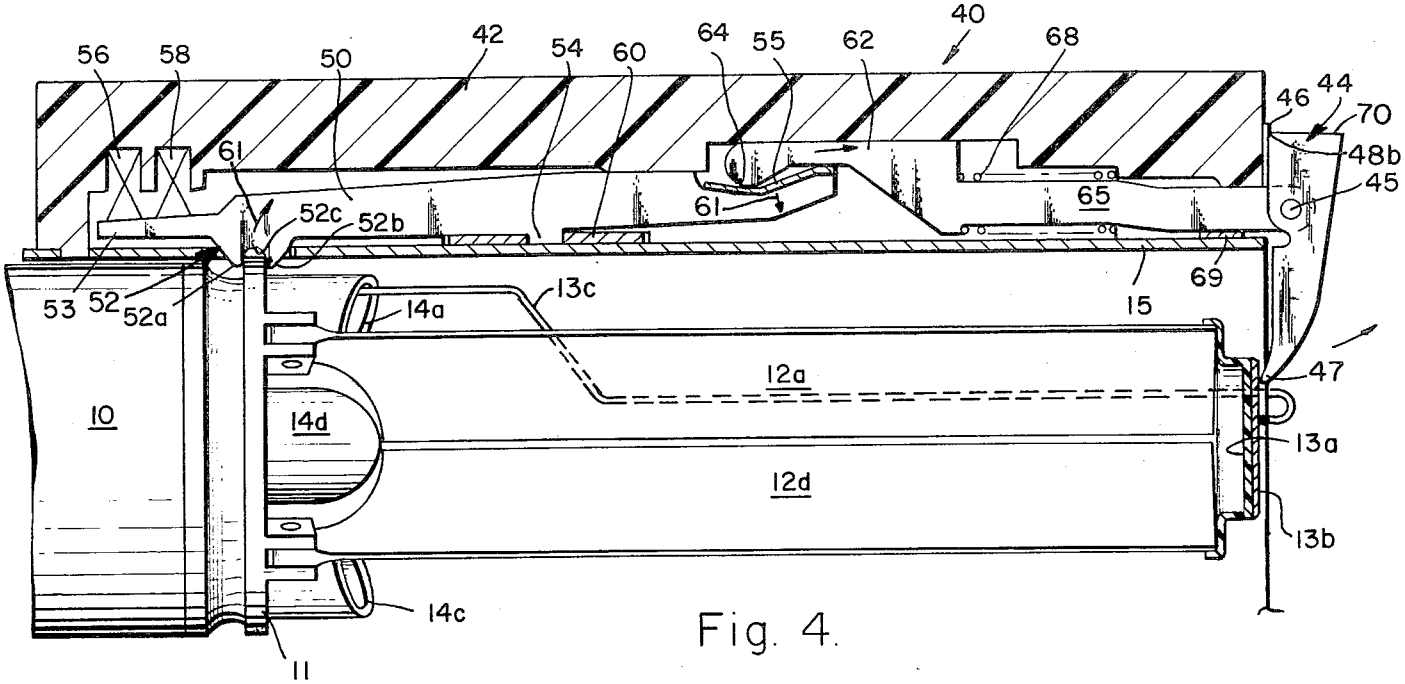
FIG. 4 is a cross-sectional side view of the rocket detent mechanism according to the present invention.

Referring more specifically to FIGS. 3 and 4, the end the invention 40 includes a housing 42 mounted onto the top of a launch tube 15. The housing 42 has a triangular shape to permit a plurality of launch tubes 15 to be assembled together into a matrix. The missile 10 is shown in place preparatory to being fired. The fin retainer 13*a* is clamped onto the fins 12*a*–12*d* (see also FIG. 4) to prevent them from being dislodged and damaged due to excessive vibrations. The central contact disc 13*b* receives the fire signal from an igniter contact arm or toggle 44. The igniter arm 44 is mounted onto the end of a connector arm 65, as best shown in FIG. 4 via a pivot point 45. As will be described more fully, the pressure of the spring loaded connector arm 65 of a sear 62 maintains electrical continuity between the igniter contact arm 44 at its fulcrum 48*b* (see FIG.5); and a contact plate 46 mounted at the end of the housing 42. The contact plate 46 behind the igniter arm 44 receives the fire signal on an electrical wire (not shown). Preferably, the housing 42 is made of a dielectric material so that the metal contact plate 46 can be mounted directly to it without insulators, to prevent shorting the fire signal to ground.

The thrust of the exhaust gases from the rocket exhaust nozzle 14*a*–14*d* pushes against the igniter arm 44 and rotates it as an over-center toggle joint, on its fulcrum 48*b* and about its pivot point 45 out of the way, thereby disengaging the positive detent described below relative to FIGS. 4 and 6.

The invention is described in greater detail in FIG.4 which illustrates a partial cross-sectional side view of the detent/release mechanism 40 along the plane 4—4 in FIG. 3 as it engages the rocket 10 in a launch tube 15.

The dielectric housing 42 mounts all the various arms and levers used in practicing the invention. The detent lever 50 has a notched detent member 52 extending through a hole in the wall of, and into the launch tube 15 to capture the circumference 11 of the rocket 10 in the notch 52*c* and thereby to lock the rocket in the tube 15. The rear lip 52*b* on one side of the notch 52*c* is slightly longer than the front lip 52*a* in order to provide a positive aft stop for the rocket if it is loaded from the forward end. The lever 50 is spring loaded towards the rocket 10 by a pair of compression springs 56 and 58 (shown schematically), which are forward of the notch 52*c* and apply a locking force to the tab 53. The compression rate and force of the springs 56 and 58 are determined by a number of parameters including the shock and vibration to which the rocket is subjected, the rocket's thrust, and the release thrust desired if the igniter arm fails to actuate the positive release feature of the invention. In this last respect, the springs 56 and 58 and the shape of the notch detent member 52 and its orientation with respect to the circumferential ridge of the rocket provide a fail safe feature in that, if the toggle action of the igniter arm otherwise malfunctions, the rocket's thrust will override the bias of the compression springs 56 and 58 to release the rocket 10.

The detent member 50 has a pivot 54 which rests within an opening in a pivot plate 60. The metal pivot plate 60 is riveted onto the housing 42 and, at one of the rivets, an electrical lug (not shown) provides the ground signal to the rocket 10 through the plate 60 and the lever 50. The other end of the detent lever 50 has a cam follower surface 55 through which the detent 52 is actuated. The pivotal action of the detent 52 is illustrated by the arrows 61.

A spring loaded sear 62 has a cam surface 64 resting against the cam follower surface 55. A return spring, shown here as a compression spring 68, is disposed about the connecting arm 65 of the sear 62 and against the housing 42. The compression force is determined by the thrust release force of the rocket and the area of the igniter arm 44 which catches the rocket blast. The sear 62 is preferably made of a dielectric material in order that the ground potential of the detent lever 50 be isolated from the fire signal applied to the igniter arm 44. A metal strap 69 toward the end of the sear's connecting arm 65 maintains the sear 62 in place.

The igniter arm 44 is connected to the sear's connecting arm 65 at the pivot point 45 and forms a T-shaped arrangement therewith, with the sear 62 forming the stem and the arm 44 forming the head or cross-bar of the T-shaped arrangement. As described above, the igniter arm 44 rests against a contact plate 46 which receives the fire signal. The igniter arm 44 has a protruding contact point 47 at its lower end for making electrical contact to the rocket's fire signal contact disc 13*b*.

Figure 5:
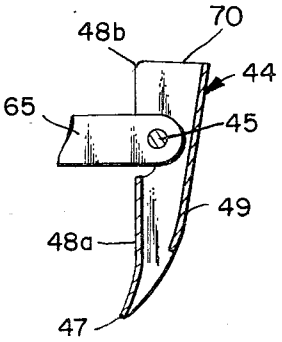
FIG. 5 is a cross-sectional side view of an igniter arm according to FIG. 3.

The structure of the igniter arm 44 is briefly described in greater detail in the cross-sectional view of FIG. 5. The front surface 48*a* receives the rocket blast for pivoting the igniter arm 44. Depending upon the thrust forces developed by a particular rocket, it may be necessary to vary the size of the front surface 48*a* from that depicted in the figure. For example, a low thrust rocket may require an igniter arm having a greater front surface and, conversely, for a high thrust rocket. The rear surface 49 adds structural integrity to the arm 44 for a longer service life. The upper leading surface 48*b* has a small radius, for example, 13 inches, to permit the igniter arm 44 to slide smoothly on the contact plate 46 as it pivots as a toggle about its pivot point 45.

Figure 6:
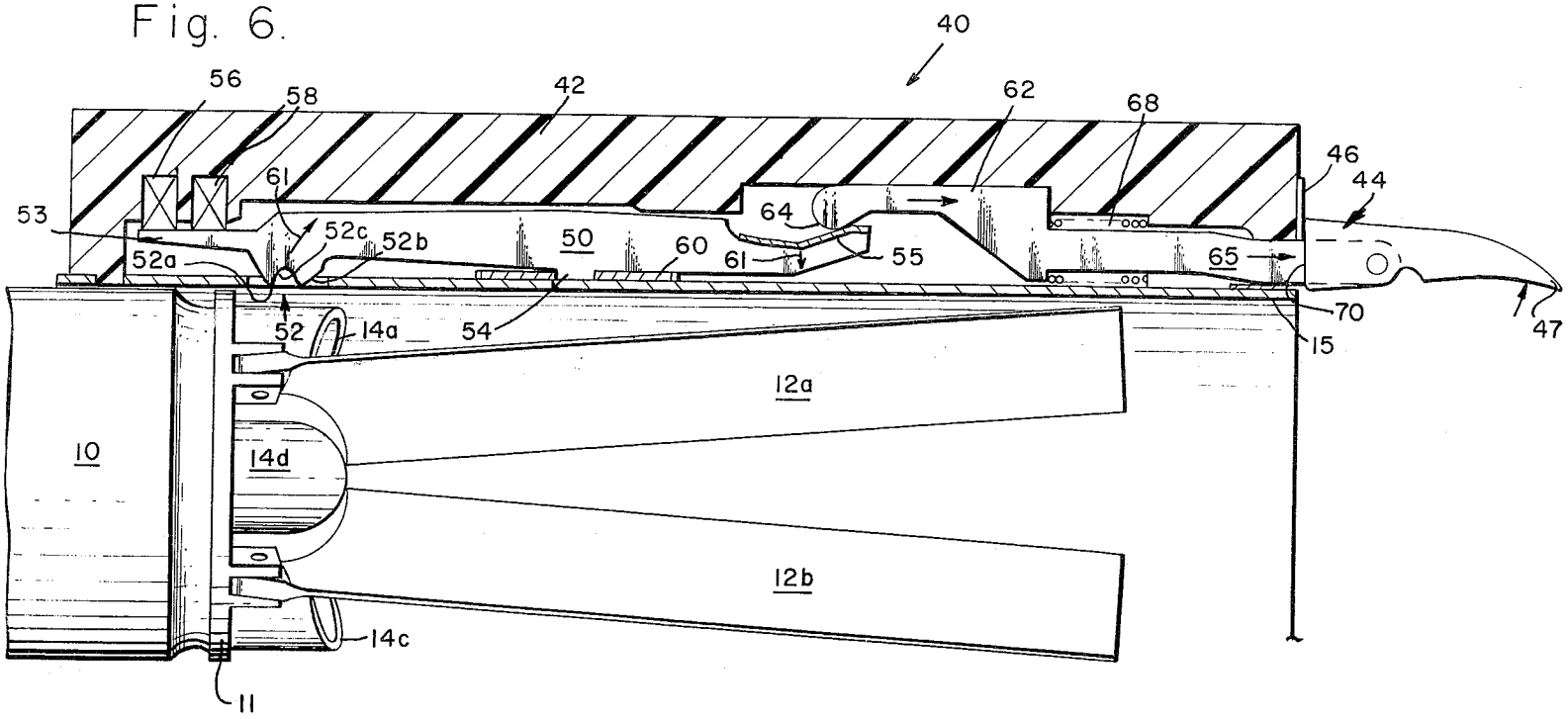
FIG. 6 is a cross-sectional side view of the invention according to FIG. 4, after actuation by a rocket blast.

FIG. 6 illustrates the rocket 10 being released from the launch tube 15. The fire signal is applied to the rocket's thrustor through the igniter arm 44 and the contact disc 13*b*. After the motor fires, it develops sufficient thrust to rotate the igniter arm 44 over-center and out of the way. Because the ignitor arm or toggle 44 is provided with a flat end surface 70, bias of the spring 68 maintains the surface 70 in contact with the plate 46 and the toggle 44 in its detent release position, as shown in FIG. 6. The rocket exhaust flow consistently produces a static pressure in the launch tube in the 25 to 50 psi range, which, when stagnated against the contact arm, develops a total pressure of 100 to 300 psi (or 25 to 150 pounds actuation force depending on selected contact frontal area and the thrust of a particular rocket). As the sear 62 is drawn rearward due to the toggle action of the arm 44, the cam surface 64 slides along and presses downward on the cam follower surface 55 to pivot the detent lever 50 about its pivot point 54. The notched detent member 52 is drawn away from the ridge 11, releasing the rocket 10. Thus, the invention provides a positive release.

One of the novel features of the present invention is that the igniter arm 44 is rotated out of the way of the rocket blast as soon as sufficient thrust has been developed to overcome the compression spring 68. Unlike most prior art igniter arms, the one of the present invention is subjected to fewer corrosive gases since it is moved out of the way. This, of course, prolongs the life of the igniter arm, which in turn prolongs the life of the entire rocket pod assembly. Up-loading of the rocket or missile is greatly simplified over the prior art devices. To load the rocket into the launch tube, one need only flip the contact igniter arm 44 up and out of the way. Thence, the rocket 10 may be loaded from either fore or aft. The amount of force required to engage the detent is drastically reduced from the previous 100+ pounds to a mere 15 or 20 pounds. The down loading capability of the rocket launcher has been greatly improved and simplified. It only requires a relatively small force of the fingers to flip the arm 44, thereby disengaging the rocket 10. Thus, the blind probing with a special pry bar of the prior art has been eliminated.

Although the invention has been shown and described with respect to particular embodiments, nonetheless, certain changes and modifications by one skilled in the art to which the invention pertains are deemed within the purview of the invention.

We claim:

1. A blast actuated missile release mechanism, comprising:

a missile supported in a launcher;

a first lever pivotally coupled to said launcher and having a detent and a cam follower, said first lever at a first position having said detent in engagement with said missile and pivotable to a second position to release said missile in response to said cam follower moving said detent out of engagement with said missile;

means including a cam disposed against said cam follower for pivoting said first lever from said first position to said second position; and a second lever pivotably coupled to said cam means, said second lever extending into the blast region of said missile and being rotated in response to a blast generated by said missile.

2. The invention according to claim 1 wherein;

said second lever has first and second surfaces, with said first surface extending into said blast region generally perpendicular to the direction of said blast, and said second surface extending beyond its respective pivot point for enabling movement of said cam means.

3. The invention according to claim 1 wherein:

said detent and said cam follower are at first and second ends of said first lever, and said pivot is centrally located thereto.

4. The invention according to claim 3 wherein:

said detent includes a notch.

5. The invention according to claim 3 further comprising:

preloading springs coupled to said first lever and applying a determined force thereon for maintaining said detent in said first position.

6. The invention according to claim 3 wherein:

said cam means comprises a sear movable in a single plane for applying pressure through said cam to said first lever in a plane generally perpendicular to said single plane.

7. The invention according to claim 6 further comprising:

a spring disposed about said cam means for maintaining said first lever in said first position and for providing a predetermined resistance against pivoting of said second lever.

8. A blast actuated release/detent mechanism, comprising:

an elongated member rockably mounted to a member supporting a missile, one end of said elongated member being spring biased in a first position into locking engagement with the missile, the other end of said elongated member having a cam follower;

a first camming member slidably mounted for movement between a first and a second location to cause, when at said second location, said first elongated member to rock from its said first position to a second position, said camming member being spring biased in its said first location; and a second, blast-actuated camming member pivotably connected to said first camming member and extending into the blast path of said missile, said second camming member being operative in response to said blast to slide said first camming member against its spring bias into its said second location, thereby forcing said first camming member to rock said first elongated member out of its missile-locking position.

9. The invention according to claim 8, wherein;

said first camming member forms the stem of a T-shaped arrangement and the second camming member forms the head of said T-shaped arrangement, said second camming member having an upper arm forming a fulcrum, and a lower arm forming a blast-catching surface.

10. A blast actuated release/detent mechanism, comprising:

a first elongated member rockably mounted on a missile-firing support and having a detent member at one end normally locked onto a missile and having a cam follower surface at the other end;

a second elongated member slidably mounted on said support and spring biased into a first position, and having first and second ends, with said first end resting against said cam follower surface, said second elongated member being slidable into a second position causing said first end to press against said cam follower surface and thereby to unlock said detent from said missile;

a blast-actuated igniter arm pivotably mounted on the second end of said second elongated member and biased by the biasing of said second elongated member against said missile-firing support, said igniter arm providing an electrical fire signal to said missile, one end of said igniter arm extending into the blast path of said missile in a first position and being actuated by the missile blast to a second position, thereby rotating it on its pivot and against said support and to cause sliding of said second elongated member from its first position to its second position.

11. A blast actuated release mechanism comprising:

a housing mounted on a missile support structure;

an elongated rocker member mounted within said housing and including a first end having a detent member in a first position in locking engagement with a missile, and a second end for rocking said detent into a second position out of said engagement;

first spring means disposed against said rocker member for maintaining said rocker member in said first position;

an elongated slidable member having first and second ends and mounted within said housing for reciprocation between first and second positions, said first end of said slidable member being in contact with said second end of said rocker member for rocking said rocker member into its second position as said slidable member is slid from its first position to its second position;

second spring means disposed against said slidable member for maintaining said slidable member biased in its first position; and a blast-actuated igniter arm pivotably mounted on said second end of said slidable member, with one end of said igniter arm extending into a blast region of said missile and being actuated in response to said blast, thereby causing said slidable member to be slid from its first position to its second position, said igniter arm receiving an electrical fire signal and providing said signal to said missile.

12. In a missile launcher having a support slidably supporting a rocket propelled missile, a movable restraining member releasably engaging said missile and restraining said missile against sliding movement along said support, and an arrangement for igniting the propellant of said rocket, the improvement comprising a pivoted rocker disposed as said movable restraining member, and a spring-loaded toggle linkage engaging said rocker and operated by a gas blast from said rocket for pivoting said rocker to release said missile.

13. A missile launcher according to claim 12, in which said toggle linkage comprises a movable spring-loaded lever engaging said restraining rocker and a rocket blast-actuated toggle lever rotatably connected to said spring-loaded lever, said toggle lever having a first toggle position in the path of the rocket gas blast and having a second toggle position when subjected to the rocket gas blast in which said spring-loaded lever moves said restraining rocker to release said missile.

14. A missile launcher according to claim 13, in which said spring-loaded lever and said movable restraining rocker respectively have complimentary engaging cam and follower surfaces, and said spring-loaded lever is moved longitudinally by said toggle lever in said second toggle position to displace said cam and cam follower surfaces and move said movable restraining rocker to release said missile.

15. A missile launcher according to claim 14, in which said movable restraining rocker has a detent displaced from said follower surface and is provided with a pivot intermediate said follower surface and said detent, and spring means engaging said rocker and rotating said rocker about said pivot to engage said detent with said missile when said toggle lever is in said first toggle position.

16. A missile launcher according to claim 15, in which the restraining force of said detent acting on said missile is insufficient to prevent missile release when subjected to the rocket thrust, in the event of failure of said toggle lever to move to said second toggle position in the presence of the rocket blast.

* * * * *